US012674236B2

(12) United States Patent
Bedrnik et al.

(10) Patent No.: US 12,674,236 B2
(45) Date of Patent: Jul. 7, 2026

(54) PASSIVATION COMPOSITION AND METHOD FOR DEPOSITING A CHROMIUM-COMPRISING PASSIVATION LAYER ON A ZINC OR ZINC-NICKEL COATED SUBSTRATE

(71) Applicant: Atotech Deutschland GmbH & Co. KG, Berlin (DE)

(72) Inventors: Lukas Bedrnik, Berlin (DE); Sebastian Hahn, Berlin (DE); Katrin Krüger, Berlin (DE)

(73) Assignee: Atotech Deutschland GmbH & Co. KG, Berlin (DE)

( * ) Notice: Subject to any disclaimer, the term of this patent is extended or adjusted under 35 U.S.C. 154(b) by 1052 days.

(21) Appl. No.: 17/778,033

(22) PCT Filed: Dec. 18, 2020

(86) PCT No.: PCT/EP2020/086981
§ 371 (c)(1),
(2) Date: May 19, 2022

(87) PCT Pub. No.: WO2021/123134
PCT Pub. Date: Jun. 24, 2021

(65) Prior Publication Data

US 2022/0411934 A1 Dec. 29, 2022

(30) Foreign Application Priority Data

Dec. 20, 2019 (EP) ..... 19218867

(51) Int. Cl.
*C23C 22/53* (2006.01)

(52) U.S. Cl.
CPC ..... *C23C 22/53* (2013.01); *C23C 2222/10* (2013.01)

(58) Field of Classification Search
None
See application file for complete search history.

(56) References Cited

U.S. PATENT DOCUMENTS

| | | | |
|---|---|---|---|
| 5,230,750 | A | 7/1993 | Shindou et al. |
| 6,096,140 | A | 8/2000 | Susa et al. |
| 6,387,538 | B1 | 5/2002 | Lee et al. |
| 2006/0237098 | A1 | 10/2006 | Matzdorf et al. |
| 2010/0203327 | A1 | 8/2010 | Inoue et al. |
| 2016/0208390 | A1 | 7/2016 | Shinozaki et al. |

FOREIGN PATENT DOCUMENTS

| | | | | |
|---|---|---|---|---|
| CN | 108914106 | A | 11/2018 | |
| DE | 19638176 | A1 | 4/1998 | |
| EP | 3045564 | A1 * | 7/2016 | ..... C23C 22/17 |
| JP | 2007239002 | A | 9/2007 | |
| WO | 2008014166 | A2 | 1/2008 | |

OTHER PUBLICATIONS

PCT/EP2020/086981; International Search Report and Written Opinion of the International Searching Authority dated Mar. 8, 2021.

* cited by examiner

*Primary Examiner* — Anthony M Liang
(74) *Attorney, Agent, or Firm* — Renner, Otto, Boisselle & Sklar, LLP

(57) ABSTRACT

The present inventions refers to a passivation composition for depositing a chromium-comprising passivation layer on a zinc or zinc-nickel coated substrate, the composition comprising:

(i) trivalent chromium ions,
(ii) at least one complexing agent for the trivalent chromium ions, being different from the at least one corrosion-inhibiting agent, and
(iii) at least one corrosion-inhibiting agent, which is
  (A) one or more than one substituted azole compound and/or salts thereof, together in a total concentration below 10 mg/L, based on the total volume of the passivation composition,
  and/or
  (B) one or more than one unsubstituted or substituted aliphatic organic acid with at least one mercapto-group and/or salts thereof, together in a total concentration in a range from 0.001 mg/L to 100 mg/L, based on the total volume of the passivation composition.

6 Claims, No Drawings

PASSIVATION COMPOSITION AND METHOD FOR DEPOSITING A CHROMIUM-COMPRISING PASSIVATION LAYER ON A ZINC OR ZINC-NICKEL COATED SUBSTRATE

This application is a national phase of International Application No. PCT/EP2020/086981 filed 18 Dec. 2020, which claims priority to European Patent Application No. 19218867.0 filed 20 Dec. 2019, each of which is hereby incorporated herein by reference in its entirety.

FIELD OF THE INVENTION

The present invention according to a first aspect relates to a passivation composition for depositing a chromium-comprising passivation layer on a zinc or zinc-nickel coated substrate. According to a second aspect, the present invention relates to a method for depositing a chromium-comprising passivation layer on a zinc or zinc-nickel coated substrate. According to a third aspect, the present invention relates to a zinc or zinc-nickel coated substrate with a chromium-comprising passivation layer thereon obtained by a method for depositing according to the second aspect.

BACKGROUND OF THE INVENTION

To protect metallic substrates from corrosive environmental influences, different methods are available according to the prior art. To apply a protective coating of a metal or metal alloy on the metallic substrate is a widely used and established method. A well know principle is the deposition of a zinc or zinc-nickel coating on metallic substrates, such as iron metal substrates, also called conversion coatings. Such conversion coatings typically comprise reaction products (which are insoluble in aqueous media over a wide pH range) of the metallic substrate with a respective conversion treatment solution. In order to further increase the corrosion resistance, such conversion layers are additionally passivated with a passivation layer by contacting a respective substrate with a passivation composition. Such passivation compositions and respective methods are known in the art.

In many cases the passivation composition comprises trivalent chromium ions in an acidic solution (see e.g. DE 196 38 176 A1). For example, if a zinc or zinc-nickel coated substrate is in contact with such a composition, typically some of the zinc and/or nickel will dissolve. Without applying any current, a chromium (III) hydroxide passivation layer or a μ-oxo or μ-hydroxo-bridged chromium (III) passivation layer is deposited on the surface of the coated substrate. As a result, a tight passivation layer is provided on the zinc or zinc-nickel coated substrate.

Compositions for depositing chromium-comprising passivation layers are described in the prior art.

EP 0 479 289 A1 describes a chromating process in which the substrates are immersed in a treatment solution, which, in addition to chromium (VI) and chromium (III) ions, comprises hydrofluoric acid, phosphoric acid, and a silane coupling agent.

EP 0 922 785 B1 describes a treatment solution and a process for the production of protective layers on metals, in which the surface to be protected is contacted with a treatment solution, which besides the chromium (III) ions, comprises an oxidizing agent and an oxyacid or an oxyacid salt of phosphorous or an appropriate anhydride. This treatment solution may further contain a monomeric silane coupling agent.

EP 1 051 539 B1 describes a treatment solution for increasing the corrosion protection of substrates which besides chromium (VI) and chromium (III) ions also comprises phosphoric acid, hydrofluoric acid, colloidal silicon dioxide and a monomeric epoxy-functionalized silanes.

WO 2008/14166 A1 describes a treatment solution for the production of anticorrosive coatings. This treatment solution comprises in addition to zinc ions, phosphoric acid or acidic phosphates, organic or inorganic anions which comprise one of the elements boron, silicon, titanium or zirconium, trivalent chromium ions and an inorganic or organic peroxide compound as an oxidizing agent.

JP 2007 239 002 discloses the suppression of iron dissolution of a substrate by applying galvanization followed by a chromate treatment.

US 2006/237098 A1 refers to compositions and to a process for using said compositions for preparing protective coatings on various metal substrates.

CN 108914106 A relates to the field of metal surface treatment liquids, in particular to a galvanized sheet surface passivation self-filling treatment liquid which is non-toxic and can realize self-filling long-term protection.

EP 3 045 564 A1 relates to a treatment liquid for a black trivalent chromium conversion coating. The treatment liquid contains a trivalent chromium compound, two or more organic acids or organic acid salts, or one or more organic sulfur compounds, and nitrate ions, and contains no cobalt compound.

EP 2 189 551 A1 relates to a trivalent-chromium chemical conversion coating from which substantially no hexavalent chromium is released.

The passivation compositions described in the prior art often do not allow for providing a chromium-comprising passivation layers with superior corrosion resistance and/or functional properties, decorative properties and/or the desired color of the corresponding chromium-comprising passivation layer.

Moreover, while such a passivation is carried out, often an increase in the concentration of iron ions in the passivation compositions is observed, which may typically result from the partial dissolution of the substrate, in particular if the protective coating of zinc or zinc-nickel is damaged. A comparatively high iron ion concentration often leads to a negative coloring of the substrate or can even impair the corrosion resistance of the substrate. Moreover, respective passivation compositions must be replaced more often, which requires a cost-intensive waste water treatment before disposal. Therefore, there is a constant demand to improve existing passivation compositions, in particular to increase the life time of such passivation compositions without compromising the quality of corrosion protection.

Objective of the Present Invention

It was therefore the objective of the present invention to provide a passivation composition and a respective method for depositing a chromium-comprising passivation layer on a nickel or zinc-nickel coated substrate, as well as the corresponding passivated substrate, which provide on the one hand an excellent corrosion protection and on the other hand an increased life time for the passivation composition and therefore a more sustainable passivation method, even in the presence of contaminating metal ions such as iron ions. Furthermore, the obtained chromium-comprising passivation layer should provide a uniform colour, ideally a blue or at least blueish colour.

SUMMARY OF THE INVENTION

The objectives mentioned above are solved according to a first aspect by a passivation composition for depositing a chromium-comprising passivation layer on a zinc or zinc-nickel coated substrate, the composition comprising:

(i) trivalent chromium ions, (ii) at least one complexing agent for the trivalent chromium ions, being different from the at least one corrosion-inhibiting agent, and (iii) at least one corrosion-inhibiting agent, which is (A) one or more than one unsubstituted or substituted (preferably substituted, most preferably only substituted and no unsubstituted) azole compound and/or salts thereof, together in a total concentration below 10 mg/L, based on the total volume of the passivation composition, and/or (preferably or)

(B) one or more than one unsubstituted or substituted aliphatic organic acid with at least one mercapto-group and/or salts thereof, together in a total concentration in a range from 0.001 mg/L to 100 mg/L, based on the total volume of the passivation composition.

By utilizing the one or more than one unsubstituted or substituted (preferably substituted, most preferably only substituted and no unsubstituted) azole compound (including salts thereof) in the specified concentration range as corrosion-inhibiting agent (A) and/or (preferably or) the one or more than one unsubstituted or substituted aliphatic organic acid with at least one mercapto-group (including salts thereof) in the specified concentration range as corrosion-inhibiting agent (B), an excellent corrosion protection of the zinc or zinc-nickel coated substrate is obtained. Typically, a blue or bluish chromium-comprising passivation layer is obtained.

Moreover, by utilizing corrosion-inhibiting agents (A) and/or (B) (preferably or), the release of iron ions from the substrate into the passivation composition is significantly suppressed. As a result, the respective passivation composition is preferably used in a respective passivation method, preferably in the method of the present invention, significantly longer compared to a passivation composition not comprising the corrosion-inhibiting agents (A) and/or (B) but otherwise being identical.

The objectives mentioned above are furthermore solved according to a second aspect by a method for depositing a chromium-comprising passivation layer on a zinc or zinc-nickel coated substrate, the method comprising the following steps:

(a) providing the zinc or zinc-nickel coated substrate, (b) providing a passivation composition for depositing a chromium-comprising passivation layer on the zinc or zinc-nickel coated substrate, the composition comprising (i) trivalent chromium ions, (ii) at least one complexing agent for the trivalent chromium ions, being different from the at least one corrosion-inhibiting agent, and (iii) at least one corrosion-inhibiting agent, which is (A) one or more than one unsubstituted or substituted (preferably substituted) azole compound and/or salts thereof, together in a total concentration below 10 mg/L, based on the total volume of the passivation composition, and/or (preferably or)

(B) one or more than one unsubstituted or substituted aliphatic organic acid with at least one mercapto-group and/or salts thereof, together in a total concentration in a range from 0.1 mg/L to 100 mg/L, based on the total volume of the passivation composition, and (c) contacting the zinc or zinc-nickel coated substrate with said passivation composition such that a chromium-comprising passivation layer is deposited on the zinc or zinc-nickel coated substrate.

The aforementioned regarding the passivation composition of the present invention applies likewise to the method of the present invention.

As mentioned above, the at least one complexing agent for the trivalent chromium ions is different from the at least one corrosion-inhibiting agent. In other words, the at least one corrosion-inhibiting agent is different from the at least one complexing agent for the trivalent chromium ions. Thus (ii) and (iii) are not the same compounds but rather different compounds, which are distinct from each other.

BRIEF DESCRIPTION OF THE TABLES

In Table 1, a schematic correlation between varying concentrations of 3-Mercaptotriazole (3-MTA) and optical appearance and corrosion resistance (NSS test) is shown.

In Table 2, a schematic correlation between varying concentrations of 3-Mercaptotriazole (3-MTA) and suppression of iron ion release is shown.

In Table 3, a schematic correlation between varying concentrations of 3-Mercaptopropionic acid (3-MPA) and suppression of iron ion release is shown.

Further details are given in the "Examples" section below in the text.

DETAILED DESCRIPTION OF THE INVENTION

In the context of the present invention, the term "at least one" or "one or more" denotes (and is exchangeable with) "one, two, three or more than three". Furthermore, "trivalent chromium" refers to chromium with the oxidation number +3. The term "trivalent chromium ions" refers to $Cr^{3+}$-ions in a free or complexed form.

In the context of the present invention, the term "chromium-comprising passivation layer" describes a layer (sometimes also referred to as a coating), which comprises preferably trivalent chromium compounds. Such a chromium-comprising passivation layer preferably comprises trivalent chromium hydroxide. In some cases it is preferred that the passivation layer comprises additional metals, preferably cobalt.

In the context of the present invention, the zinc or zinc-nickel coated substrate comprises iron. This means that the substrate preferably comprises a base material, preferably a ferrous base material, more preferably steel, on which the zinc or zinc-nickel coating has been deposited. Therefore, preferably iron ions are released from the substrate and base material, respectively, which in particular occurs if the zinc or zinc-nickel coating is damaged.

Preferred is a passivation composition of the present invention, wherein the passivation composition is an aqueous composition, wherein preferably the concentration of water is more than 50 vol.-%, based on the total volume of the aqueous composition, more preferably 75 vol.-% or more, most preferably 90 vol.-% or more.

Preferred is a passivation composition of the present invention for depositing a blue (or bluish) chromium-comprising passivation layer on a zinc or zinc-nickel coated substrate.

Preferred is a passivation composition of the present invention, wherein the one or more than one substituted azole compound and/or the salts thereof comprises one or more than one substituent selected from the group consisting of amino, nitro, carboxy, hydroxy, sulfonate, and thiol, wherein preferably the substituent is a thiol group.

Preferred is a passivation composition of the present invention, wherein the one or more than one unsubstituted or substituted (preferably the substituted) azole compound and/or the salts thereof are selected from the group consisting of monoazoles, diazoles, triazoles, and tetrazoles, preferably diazoles and triazoles, most preferably triazoles.

Preferred is a passivation composition of the present invention, wherein the one or more than one unsubstituted or substituted (preferably the substituted) azole compound and/or the salts thereof are selected from the group consisting of 1,2,4-triazoles. This most preferably means 1,2,4-H-triazoles.

Preferred is a passivation composition of the present invention, wherein the one or more than one substituted azole compound and/or the salts thereof comprises at least a mercaptotriazole, preferably at least 3-mercapto-1,2,4-triazole (most preferably denoting 3-mercapto-1,2,4-H-triazole).

The term "together in a total concentration below 10 mg/L" denotes that (A) is present but only up to below 10 mg/L. 10 mg/L are explicitly excluded. The wording also denotes that 0 mg/L are excluded. Preferred is a passivation composition of the present invention, wherein the at least one corrosion-inhibiting agent (A) has a total concentration in a range from 0.0001 mg/L to 9.9999 mg/L, based on the total volume of the passivation composition, preferably from 0.01 mg/L to 9.9 mg/L, more preferably from 0.1 mg/L to 9.8 mg/L, even more preferably from 0.5 mg/L to 9.7 mg/L, yet even more preferably from 1.0 mg/L to 9.6 mg/L, most preferably from 2.0 mg/L to 9.5 mg/L, and even most preferably from 3.0 mg/L to 9.4 mg/L.

In own experiments, the corrosion-inhibiting agent (A), preferably as defined above as being preferred, more preferably in a concentration range as defined above, the release of iron ions from the substrate is excellently suppressed on the one hand and an excellent corrosion protection can be obtained on the other hand. If the concentration of corrosion-inhibiting agent (A) is significantly exceeding 9.9999 mg/L in many cases an insufficient corrosion protection is observed (see examples below).

Regarding corrosion-inhibiting agent (B), preferred is a passivation composition of the present invention, wherein the one or more than one unsubstituted or substituted aliphatic organic acid with at least one mercapto-group and/or salts thereof is a carboxylic acid.

More preferred is a passivation composition of the present invention, wherein the one or more than one unsubstituted or substituted aliphatic organic acid with at least one mercapto-group and/or salts thereof comprises a mono-carboxylic acid.

Preferred is a passivation composition of the present invention, wherein the one or more than one unsubstituted or substituted aliphatic organic acid with at least one mercapto-group and/or salts thereof comprises 1 to 12 carbon atoms, preferably 2 to 10 carbon atoms, more preferably 3 to 8 carbon atoms, most preferably 3 to 6 carbon atoms.

Preferred is a passivation composition of the present invention, wherein the one or more than one unsubstituted or substituted aliphatic organic acid with at least one mercapto-group and/or the salts thereof comprises 3-mercaptopropionic acid and/or salts thereof, most preferably is 3-mercaptopropionic acid.

Preferred is a passivation composition of the present invention, wherein the at least one corrosion-inhibiting agent (B) has a total concentration in a range from 0.01 mg/L to 90 mg/L, based on the total volume of the passivation composition, preferably from 0.1 mg/L to 80 mg/L, more preferably from 1 mg/L to 50 mg/L, even more preferably from 2 mg/L to 35 mg/L, most preferably from 3 mg/L to 20 mg/L.

Again, in own experiments, the corrosion-inhibiting agent (B), preferably as defined above as being preferred, more preferably in a concentration range as defined above, the release of iron ions from the substrate is excellently suppressed on the one hand and an excellent corrosion protection can be obtained on the other hand. If the concentration of corrosion-inhibiting agent (B) is significantly exceeding 100 mg/L usually an insufficient corrosion protection is observed (see examples below).

Although corrosion-inhibiting agent (A) as well as corrosion-inhibiting agent (B) are in some cases utilized together, it is usually preferred that either corrosion-inhibiting agent (A) or corrosion-inhibiting agent (B) is utilized in the passivation composition of the present invention. Typically, the excellent results are already obtained if one of (A) and (B) is utilized in the passivation composition of the present invention.

Preferred is a passivation composition of the present invention, wherein the passivation composition comprises trivalent chromium ions in a total concentration from 0.1 g/L to 25 g/L, based on the total volume of the passivation composition, preferably from 0.2 g/L to 20 g/L, more preferably from 0.35 g/L to 15 g/L, even more preferably from 0.5 g/L to 10 g/L, most preferably from 1.0 g/L to 8 g/L.

In some cases very preferred is a passivation composition of the present invention, wherein the passivation composition comprises trivalent chromium ions in a total concentration from 0.5 g/L to 2.5 g/L.

If the total concentration is significantly below 0.1 g/L typically an insufficient passivation is obtained.

Preferred is a passivation composition of the present invention, wherein the at least one complexing agent for the trivalent chromium ions is selected from the group consisting of organic complexing agents and inorganic complexing agents. The proviso applies that the organic complexing agent is different from the at least one corrosion-inhibiting agent as defined throughout the present text.

Preferred is a passivation composition of the present invention, wherein the at least one complexing agent for the trivalent chromium ions is selected from the group consisting of monocarboxylic acids, dicarboxylic acids, salts thereof (of both monocarboxylic acids and dicarboxylic acids), halogen ions, and mixtures thereof, and preferably comprises at least one dicarboxylic acid.

Preferred is a passivation composition of the present invention, wherein the at least one complexing agent for the trivalent chromium ions is selected from the group consisting of unsubstituted monocarboxylic acids, hydroxyl-substituted monocarboxylic acids, amino-substituted monocarboxylic acids, unsubstituted dicarboxylic acids, hydroxyl-substituted dicarboxylic acids, amino-substituted dicarboxylic acids, salts thereof (of all aforementioned acids), halogen ions, and mixtures thereof, and preferably comprises at least one dicarboxylic acid.

Preferred is a passivation composition of the present invention, wherein the at least one complexing agent for the trivalent chromium ions is selected from the group consisting of oxalate/oxalic acid, acetate/acetic acid, tartrate/tartaric acid, malate/malic acid, succinate/succinic acid, gluconate/gluconic acid, glutamate/glutamic acid, glycolate/glycolic acid, diglycolate/diglycolic acid, ascorbate/ascorbic acid, and butyrate/butyric acid.

Preferred is a passivation composition of the present invention, wherein the halogen ions comprise fluoride.

Preferred is a passivation composition of the present invention, wherein the at least one complexing agent for the trivalent chromium ions does not comprise a mercapto-group.

In some cases preferred is a passivation composition of the present invention, wherein the at least one complexing agent for the trivalent chromium ions has a total concentration in a range from 0.3 mol/L to 2.0 mol/L, based on one mol/L trivalent chromium ions in the passivation composition, preferably from 0.4 mol/L to 1.9 mol/L, more preferably from 0.5 mol/L to 1.8 mol/L, even more preferably from 0.6 mol/L to 1.7 mol/L.

Also preferred is a passivation composition of the present invention, wherein the at least one complexing agent for the trivalent chromium ions has a total concentration in a range from 1.0 wt.-% to 15.0 wt.-%, based on the total weight of the passivation composition, preferably from 2.0 wt.-% to 14.0 wt.-%, more preferably from 3.0 wt.-% to 13.0 wt.-%, even more preferably from 4.0 wt.-% to 12.0 wt.-%, most preferably from 5.0 wt.-% to 11.0 wt.-%.

Typically, in the above defined preferred concentration ranges the trivalent chromium ions are efficiently stabilized in the passivation composition by the complexing agents (preferably complexing agents as defined as being preferred).

In some cases a passivation composition of the present invention is preferred, further comprising (iv) divalent cobalt ions, preferably in a total concentration from 1.0 wt.-% to 5.0 wt.-%, based on the total weight of the passivation composition, preferably from 2.5 wt.-% to 3.0 wt.-%.

In many cases, cobalt ions positively affects an optional heat-treating (for heat-treating see text below).

In a particular alternative passivation composition according to the present text, the passivation composition comprises (i) trivalent chromium ions, (ii) at least one complexing agent for the trivalent chromium ions, being different from the at least one corrosion-inhibiting agent, and (iii) at least one corrosion-inhibiting agent, which is (A) one or more than one unsubstituted or substituted (preferably substituted) azole compound and/or salts thereof, together in a total concentration from 0.001 mg/L to 100 mg/L, based on the total volume of the passivation composition, and/or (B) one or more than one unsubstituted or substituted aliphatic organic acid with at least one mercapto-group and/or salts thereof, together in a total concentration in a range from 0.001 mg/L to 100 mg/L, based on the total volume of the passivation composition, and (iv) divalent cobalt ions, preferably in a total concentration from 1.0 wt.-% to 5.0 wt.-%, based on the total weight of the passivation composition, preferably from 2.5 wt.-% to 3.0 wt.-%.

In this particular passivation composition according to the present text, for (A) the preferred total concentrations as for (B) preferably apply. Preferably, features of the passivation composition of the present invention apply likewise to the alternative passivation composition.

However, in some cases a passivation composition of the present invention is preferred, wherein the passivation composition is essentially free of or does not comprise divalent cobalt ions, preferably, is essentially free of or does not comprise cobalt ions, most preferably is essentially free of or does not comprise cobalt. By alternatively excluding cobalt or cobalt ions from the passivation composition, a cost-reduction is typically achieved, since the use of expensive cobalt compounds is avoided, and the waste water treatment is simplified, without compromising the quality of corrosion protection.

Preferred is a passivation composition of the present invention, having a pH in a range from 0.5 to 5.0, preferably from 1.0 to 4.0, more preferably from 1.4 to 3.0, even more preferably from 1.6 to 2.5, most preferably from 1.8 to 2.3. If the pH is significantly exceeding 5.0, in some cases undesired precipitation is observed. If the pH is significantly below 0.5, in some cases an undesired strong dissolution of the coated substrate is observed. The preferred pH ranges as defined above are in particular beneficial for effectively depositing the chromium-comprising passivation layer and to maintain a comparatively long life time of the passivation composition.

Preferred is a passivation composition of the present invention, further comprising (v) iron ions in a total concentration from 0 mg/L to 500 mg/L, based on the total volume of the passivation composition, preferably from 0 mg/L to 400 mg/L, more preferably from 0 mg/L to 300 mg/L, most preferably 0 mg/L to 250 mg/L, even most preferably from 0 mg/L to 200 mg/L.

Due to the presence of corrosion-inhibiting agent (A) and/or (B), a comparatively high concentration of iron ions is tolerable without compromising the quality of the corrosion protection, thereby prolonging the life time of a respective passivation composition.

In some cases, iron ions are permanently present at a very low concentration and most preferably not even reaching the upper concentration limits as defined above. In view of the present invention, this is not critical. Such a typical very low concentration of the iron ions is preferably 0.001 mg/L or more, based on the total volume of the passivation composition, more preferably 0.01 mg/L, even more preferably 0.1 mg/L, and most preferably 1 mg/L. Preferably, such low concentrations are combined with the upper concentration limits defined above.

The present invention according to the second aspect provides a method for depositing a chromium-comprising passivation layer (preferably a blue or bluish chromium-comprising passivation layer) on a zinc or zinc-nickel coated substrate, the method comprising the following steps:

(a) providing the zinc or zinc-nickel coated substrate, (b) providing a passivation composition for depositing a chromium-comprising passivation layer on the zinc or zinc-nickel coated substrate (preferably as defined above, more preferably as defined above as being preferred), the composition comprising (i) trivalent chromium ions, (ii) at least one complexing agent for the trivalent chromium ions, being different from the at least one corrosion-inhibiting agent, and (iii) at least one corrosion-inhibiting agent, which is (A) one or more than one unsubstituted or substituted (preferably substituted) azole compound and/or salts thereof, together in a total concentration below 10 mg/L, based on the total volume of the passivation composition, and/or (preferably or)

(B) one or more than one unsubstituted or substituted aliphatic organic acid with at least one mercapto-group and/or salts thereof, together in a total concentration in a range from 0.1 mg/L to 100 mg/L, based on the total volume of the passivation composition, and (c) contacting the zinc or zinc-nickel coated substrate with said passivation composition such that a chromium-comprising passivation layer is deposited on the zinc or zinc-nickel coated substrate.

Preferably, the aforementioned regarding the passivation composition of the present invention (in particular what is defined as being preferred) applies likewise to the method of the present invention.

Most preferred is a method of the present invention, wherein step (c) is performed without applying an electrical current.

Preferred is a method of the present invention, wherein in step (a) the zinc or zinc-nickel coated substrate is a metal screw, a metal nut, a metal clamp and/or a metal spring.

Preferred is a method of the present invention, wherein step (c) is performed at a temperature in a range from 20° C. to 50° C., and/or wherein step (c) is performed for a time period from 10 sec to 180 sec.

If the temperature is significantly exceeding 50° C., in some cases an undesired evaporation of water is observed along with an undesired consumption of energy.

If the temperature is significantly below 20° C., in many cases an insufficient depositing of the chromium-comprising passivation layer is obtained, thereby compromising the quality of the corrosion protection.

If the time period is significantly below 10 sec, in many cases an insufficient depositing of the chromium-comprising passivation layer is obtained, thereby compromising the quality of the corrosion protection.

Preferred is a method of the present invention, wherein step (c) is performed for a time period from 20 sec to 170 sec, preferably from 30 sec to 150 sec, more preferably from 40 sec to 110 sec, even more preferably from 50 sec to 90 sec.

Preferred is a method of the present invention, wherein step (c) is performed at a temperature in a range from 21° C. to 45° C., preferably from 22° C. to 40° C., more preferably from 23° C. to 35° C. Such moderate temperatures allow a sustainable operation of the method of the present invention.

By performing step (c) in the preferred temperature ranges and the preferred time periods, particularly advantageous deposition kinetics are obtained.

Preferred is a method of the present invention, wherein the concentration of iron ions in the passivation composition after step (c) is 200 mg/L or less, based on the total volume of the passivation composition, preferably 100 mg/L or less, most preferably 200 mg/L or less after each step (c), even most preferably 100 mg/L or less after each step (c).

More preferred is a method of the present invention, wherein after step (c) the concentration of iron ions in the passivation composition is 500 mg/L or less, based on the total volume of the passivation composition, preferably 400 mg/L or less, more preferably 300 mg/L or less, most preferably 250 mg/L or less, even most preferably 200 mg/L or less, each with the proviso that the passivation composition comprises zinc ions with a concentration of 15 g/L or less.

Even more preferred is a method of the present invention, wherein after step (c) the concentration of iron ions in the passivation composition is 500 mg/L or less, based on the total volume of the passivation composition, preferably 400 mg/L or less, more preferably 300 mg/L or less, most preferably 250 mg/L or less, even most preferably 200 mg/L or less, each with the proviso that the passivation composition comprises zinc ions with a concentration of 10 g/L or less.

Preferred is a method of the present invention, wherein the method comprises after step (c), additional step (d) heat-treating the zinc or zinc-nickel coated substrate.

In many cases, the heat-treating improves in order to minimize hydrogen embrittlement.

Preferred is a method of the present invention, wherein in step (d) the heat-treating is performed at a temperature in a range from 150° C. to 230° C., preferably from 180° C. to 210° C.

Preferred is a method of the present invention, wherein in step (d) the heat-treating is performed for a time period from 1 hour to 10 hours, preferably from 2 hours to 8 hours, most preferably from 2.5 hours to 5 hours.

Preferred is a method of the present invention, wherein after step (c) and/or (d) the zinc or zinc-nickel coated substrate with the chromium-comprising passivation layer has a white rust formation of 1% or below according to DIN 9227. A white rust formation of 1% or below according to DIN 9227 serves as a particular good criteria for proving the excellent corrosion protection obtained with the method of the present invention.

Preferred is a method of the present invention, wherein the substrate comprises iron, more preferably steel.

In some cases, preferred is a method of the present invention, wherein the zinc or zinc-nickel coated substrate is a zinc-nickel coated substrate. In other cases, preferred is a method of the present invention, wherein the zinc or zinc-nickel coated substrate is a zinc coated substrate.

In some cases preferred is a method of the present invention, wherein the method comprises after step (c) or (d), additional step (e) sealing the zinc or zinc-nickel coated substrate with the chromium-comprising passivation layer obtained after step (c) or (d), respectively, such that a passivated zinc or zinc-nickel coated substrate with a sealing layer is obtained.

Preferred is a method of the present invention, wherein the sealing layer comprises one or more than one compound selected from the group consisting of inorganic silicates (preferably as particles), silanes, organic polymers and mixtures thereof.

Regarding aforementioned inorganic silicates (preferably as particles), alternatively or in addition such particles are preferably comprised in the passivation composition of the present invention in order to increase corrosion protection.

Preferred is a method of the present invention, wherein after step (c) the chromium-comprising passivation layer has a layer thickness in a range from 1 nm to 1200 nm, preferably from 10 nm to 1000 nm, more preferably from 15 nm to 800 nm, most preferably from 20 nm to 500 nm.

Even more preferred is a method of the present invention, wherein after step (c) the chromium-comprising passivation layer is blue (or at least bluish) and has a layer thickness in a range from 30 nm to 150 nm, preferably from 40 nm to 140 nm, more preferably from 45 nm to 130 nm, most preferably from 50 nm to 120 nm, and even most preferably from 55 nm and 90 nm.

In a few cases a method of the present invention is preferred, wherein after step (c) the chromium-comprising passivation layer is iridescent and has a layer thickness in a range from 155 nm to 1200 nm, preferably from 170 nm to 1000 nm, more preferably from 190 nm to 800 nm, most preferably from 200 nm to 600 nm.

In a few cases a method of the present invention is preferred, wherein after step (c) the chromium-comprising passivation layer is transparent or yellow and has a layer thickness in a range from 1 nm to 25 nm, preferably from 3 nm to 22 nm, more preferably from 5 nm to 20 nm, most preferably from 8 nm to 18 nm.

The present invention according to the third aspect provides a zinc or zinc-nickel coated substrate with a chromium-comprising passivation layer thereon obtained by a method for depositing according to the second aspect.

Preferably, the aforementioned regarding the passivation composition of the present invention (in particular a passivation composition as defined as being preferred) and most preferably regarding the method of the present invention (in particular a method as defined as being preferred) applies likewise to the zinc or zinc-nickel coated substrate with the chromium-comprising passivation layer thereon according to the present invention.

The present invention is described in more detail by the following non-limiting examples.

EXAMPLES

1. First Set of Experiments

In a first set of experiments, aqueous test passivation compositions with the numbering as introduced in Table 1 were prepared, generally comprising appr. 2 g/L trivalent chromium ions, cobalt ions, a dicarboxylic acid as complexing agent, and 3-Mercaptotriazole (3-MTA) as corrosion-inhibiting agent, pH 2.2.

The method of the present invention was carried out as follows: As substrates zinc coated iron screws (M8×60) were pre-treated and subsequently passivated for 30 seconds in the respective aqueous test passivation compositions (volume each: 2 L) at room temperature (appr. 20° C.). Afterwards the passivated screws were optically inspected and subjected to a NSS test (24 h).

Further details regarding the passivation compositions and the results obtained after passivation are summarized in Table 1.

TABLE 1

| Exp. | 3-MTA [mg/L] | ht | NSST | colour |
|---|---|---|---|---|
| 1 | 5 | – | + | + |
| 2 | 5 | + | + | + |
| C1 | 25 | – | 0 | – |
| C2 | 25 | + | 0 | – |
| C3 | 50 | – | – | – |
| C4 | 50 | + | – | – |
| C5 | 100 | – | – | – |
| C6 | 100 | + | – | – |
| C7 | 250 | – | – | – |
| C8 | 250 | + | – | – |
| C9 | 500 | – | – | – |
| C10 | 500 | + | – | – |
| C11 | 0 | – | + | + |
| C12 | 0 | + | + | + |

In Table 1, abbreviations have the following meaning:

"ht" means heat treatment of the passivated substrate, wherein "–" denotes no heat treatment and "+" denotes a heat treatment at 210° C. for 4 hours;

"NSST" denotes neutral salt spray test according to DIN 9227 with a duration of 24 h and 1% or less white rust formation, wherein "+" denotes that the test was excellently met with no rust formation; "0" denotes a still acceptable white rust formation; and "–" denotes significantly more than 1% white rust;

"colour" refers to the optical appearance of the substrate after passivation, wherein "+" denotes blue and "–" denotes transparent or any other colour not being blue;

Experiments 1 and 2 are examples according to the invention, wherein experiments C1 to C12 are comparative examples. Very similar results were obtained with an immersion time of 50 seconds, pH 2.5 (data not shown).

In this first set of experiments, no iron ions were present in the aqueous test passivation compositions (i.e. not actively added and not expected in the compositions due to the short utilization). Typically, such iron ions negatively affect the corrosion resistance in respective coated substrates, e.g. in a NSS test. Experiments 1 and 2 and C1 to C12 clearly show how the corrosion resistance is affected in the presence of varying concentrations of 3-MTA, wherein optimal corrosion resistance of the substrate and blue colour of the passivation layer was observed for Experiments 1 and 2.

Since no iron ions were present, comparative examples C11 and C12 showed excellent results even without any 3-MTA present. Comparative examples C11 and C12 represent an ideal situation, in which no iron ion contamination is present or expected and thus no corrosion inhibitor must be utilized. However, such ideal situation typically does not represent the day-to-day situation, wherein an increased iron ion contamination is present or at least expected.

As shown in the second set of experiments below, 3-MTA is a well operating corrosion-inhibiting agent if iron ions are present. However according to Table 1, examples 1 and 2 show that only comparatively low concentrations of 3-MTA can be tolerated in order to maintain an excellent corrosion resistance of the substrate and blue colour of the passivation layer. This result is comparable to comparative examples C11 and C12, which do not comprise any corrosion inhibiting agent. As clearly seen by comparative examples C1 to C10, a concentration of 3-MTA in the range from 25 mg/L to 500 mg/L negatively affects the corrosion resistance of respective substrates (see column "NSST" with "0" or even "–") and also results in a transparent passivation layer or in a passivation layer with a colour not being blue.

2. Second Set of Experiments

In a second set of experiments, aqueous test passivation compositions had the same basic composition as the test passivation compositions of the first set of experiments. However, in the second set of experiments iron ions were added as follows:

In a first step, 100 ml of each aqueous test passivation composition were prepared without iron ions in a respective beaker. The pH was adjusted to 2.5.

In a second step, an iron substrate (a 3.5 cm×5.0 cm iron plate) was placed into each beaker for 2 hours to allow iron ions to dissolve in the respective aqueous test passivation composition. The dissolution of iron was affected by the presence of 3-MTA in the passivation composition. Afterwards, the concentration of free iron ions was gravimetrically determined. Further details and results are summarized in Table 2.

TABLE 2

| Exp. | 3-MTA [mg/L] | pH | Fe [g/L] |
|---|---|---|---|
| 3 | 7 | 2.6 | 0.02 |
| C13 | 25 | 2.6 | 0.02 |
| C14 | 100 | 2.6 | 0.02 |
| C15 | 0 | 4.2 | 0.13 |

As shown in Table 2, 3-MTA is a well operating corrosion-inhibiting agent, which actively prevents the release if iron ions from iron-comprising substrates. In the absence of 3-MTA (comparative example C15), 0.13 g/L iron ions were determined. However, in the presence of only 7 mg/L (example 3) the release of iron ions is significantly reduced and is not further improved with increasing amounts of 3-MTA (comparative examples C13 and C14). Furthermore, the dissolution of the iron substrate and the respective release of iron ions is significantly affecting the pH (comparative example C15).

Although 3-MTA in concentrations of 25 and 100 mg/L, respectively, well prevents the release of iron ions (comparative examples C13 and C14), Table 1 clearly shows that such concentrations negatively affect the corrosion resistance of respective passivated substrates (comparative examples C1, C2, C5 and C6 of the first set of experiments).

Very similar results and conclusions were obtained with 5-Mercapto-1-methyltetrazole (data not shown).

3. Third Set of Experiments

In a third set of experiments, aqueous test passivation compositions were prepared similar to the test passivation compositions of the first set of experiments with the difference that 3-Mercaptopropionic acid (3-MPA) was used instead of 3-MTA. In a series of respective NSS tests, corrosion resistance was not compromised (i.e. "NSST" with "+") until a concentration of approximately 60 mg/L of 3-MPA was reached, and only insignificantly compromised (i.e. "NSST" with "0") until a concentration of approximately 100 mg/L of 3-MPA was reached.

Significantly above 100 mg/L no acceptable corrosion resistance was obtained (i.e. "NSST" with "–"). Thus, 3-MPA provides a larger working range with respect to the concentration that can be used without significantly decreasing the corrosion resistance compared to 3-MTA.

Furthermore, 3-MPA was additionally tested in the same way as 3-MTA was tested in the second set of experiments. Further details and results are summarized in Table 3.

TABLE 3

| Exp. | 3-MPA [mg/L] | pH | Fe [g/L] |
|---|---|---|---|
| 4 | 7 | 2.6 | 0.023 |
| 5 | 100 | 2.5 | 0.022 |
| C16 | 3000 | 2.3 | 0.012 |
| C17 | 0 | 3.7 | 0.12 |

Although examples 4, 5, and comparative example C16 excellently prevent the release of iron ions even with increasing concentration of 3-MPA, own experiments have shown that an acceptable corrosion resistance cannot be obtained with a 3-MPA concentration of significantly above 100 mg/L. However, within a working range of 3-MPA from 100 mg/L and below, preferably 50 mg/L or below, excellent and acceptable, respectively, results are obtained.

In each case, the sets of experiments show that a concentration of approximately 250 mg/L iron ions can be tolerated in a respective passivation composition if a corrosion-inhibiting agent is present.

The invention claimed is:

1. An aqueous passivation composition for depositing a chromium-comprising passivation layer on a zinc or zinc-nickel coated substrate, the aqueous passivation composition comprising:

(i) trivalent chromium ions, present in a total concentration from 0.5 g/L to 10 g/L, based on the total volume of the aqueous passivation composition;

(ii) at least one complexing agent for the trivalent chromium ions selected from the group consisting of monocarboxylic acids, dicarboxylic acids, salts thereof, and mixtures thereof, and (iii) at least one corrosion-inhibiting agent, which is different from the at least one complexing agent for the trivalent chromium ions and comprises (A) one or more than one substituted azole compound and/or salts thereof, together in a total concentration below 10 mg/L, comprising at least 3-mercapto-1,2,4-triazole in a range from 3.0 mg/L to 9.4 mg/L, based on the total volume of the aqueous passivation composition, (B) one or more than one unsubstituted or substituted aliphatic organic acid with at least one mercapto-group and/or salts thereof, together in a total concentration in a range from 0.001 mg/L to 100 mg/L, comprising at least 3-mercapto-propionic acid and/or salts thereof in a range from 2 mg/L to 35 mg/L, based on the total volume of the aqueous passivation composition, or both (A) and (B), and wherein the aqueous passivation composition has a pH in a range from 1.0 to 4.0.

2. The passivation composition according to claim 1, wherein the at least one complexing agent for the trivalent chromium ions is selected from the group consisting of unsubstituted monocarboxylic acids, hydroxyl-substituted monocarboxylic acids, amino-substituted monocarboxylic acids, unsubstituted dicarboxylic acids, hydroxyl-substituted dicarboxylic acids, amino-substituted dicarboxylic acids, salts thereof, halogen ions, and mixtures thereof.

3. The passivation composition according to claim 1, wherein the at least one complexing agent for the trivalent chromium ions has a total concentration in a range from 1.0 wt.-% to 15.0 wt.-%, based on the total weight of the passivation composition.

4. The passivation composition according to claim 1, further comprising (v) iron ions in a total concentration from 0 mg/L to 500 mg/L, based on the total volume of the passivation composition.

5. A method for depositing a chromium-comprising passivation layer on a zinc or zinc-nickel coated substrate, the method comprising the following steps:

(a) providing the zinc or zinc-nickel coated substrate, (b) providing a passivation composition for depositing a chromium-comprising passivation layer on the zinc or zinc-nickel coated substrate, comprising the aqueous passivation composition according to claim 1;

and (c) contacting the zinc or zinc-nickel coated substrate with said aqueous passivation composition such that a chromium-comprising passivation layer is deposited on the zinc or zinc-nickel coated substrate.

6. The method according to claim 5, wherein step (c) is performed at a temperature in a range from 20° C. to 50° C., wherein step (c) is performed for a time period from 10 sec to 180 sec, or wherein step (c) is performed at a temperature in a range from 20° C. to 50° C. and for a time period from 10 sec. to 180 sec.

* * * * *